US011712390B2

(12) United States Patent
Chen et al.

(10) Patent No.: US 11,712,390 B2
(45) Date of Patent: Aug. 1, 2023

(54) ORAL REHABILITATION DEVICE AND MEDICAL TREATMENT SYSTEM THEREWITH

(71) Applicant: CHANGHUA CHRISTIAN MEDICAL FOUNDATION CHANGHUA CHRISTIAN HOSPITAL, Changhua County (TW)

(72) Inventors: Mu-Kuan Chen, Changhua County (TW); Gene Chen, Nantou County (TW); Po-Te Lin, Changhua County (TW); Chih-Hua Chen, Taichung (TW); Ming-Yu Hsieh, Taichung (TW); Mei-Hui Chang, Changhua County (TW)

(73) Assignee: CHANGHUA CHRISTIAN MEDICAL FOUNDATION CHANGHUA CHRISTIAN HOSPITAL, Changhua County (TW)

( * ) Notice: Subject to any disclaimer, the term of this patent is extended or adjusted under 35 U.S.C. 154(b) by 967 days.

(21) Appl. No.: 16/595,516

(22) Filed: Oct. 8, 2019

(65) Prior Publication Data

US 2020/0113768 A1 Apr. 16, 2020

(30) Foreign Application Priority Data

Oct. 11, 2018 (TW) ..... 107135685

(51) Int. Cl.
*A61H 1/02* (2006.01)

(52) U.S. Cl.
CPC ..... *A61H 1/02* (2013.01); *A61H 2201/0153* (2013.01); *A61H 2201/5007* (2013.01);
(Continued)

(58) Field of Classification Search
CPC ..... A61H 1/02; A61H 1/00; A61H 2205/026; A61H 2205/0153; A61H 2205/5077;
(Continued)

(56) References Cited

U.S. PATENT DOCUMENTS 5,097,820 A * 3/1992 Shulman ..... A61B 1/24 600/237
6,558,392 B1 * 5/2003 Martini ..... A61B 17/025 606/208

(Continued)

FOREIGN PATENT DOCUMENTS

CN 104306131 B 4/2016
CN 104840330 B 9/2016

(Continued)

*Primary Examiner* — Samchuan C Yao
*Assistant Examiner* — Nathan M Le
(74) *Attorney, Agent, or Firm* — Winston Hsu

(57) ABSTRACT

An oral rehabilitation device for rehabilitating the oral cavity of a user includes a device body, a first activating member, an upper-jaw member, a lower-jaw member, and a processing unit. The first activating member is disposed on an end of the device body. The upper-jaw member and the lower-jaw member are connected to the same end of the device body and are for contacting an upper jaw and lower jaw of the user, respectively. The processing unit is coupled to the first activating member and is used to control the first activating member to drive one of the upper-jaw member and the lower jaw member to open or close relative to the other of the upper-jaw member and the lower-jaw member, such that the upper jaw and the lower jaw can be rehabilitated. The present invention further discloses a medical treatment system to which the oral rehabilitation device is linked.

20 Claims, 10 Drawing Sheets

(52) U.S. Cl.
CPC ..... *A61H 2201/5043* (2013.01); *A61H 2201/5069* (2013.01); *A61H 2201/5071* (2013.01); *A61H 2205/026* (2013.01)

(58) Field of Classification Search
CPC ..... A63B 23/032; A63B 21/4047; A61B 1/24; A61C 7/10
See application file for complete search history.

(56) References Cited

U.S. PATENT DOCUMENTS

| | | | | |
|---|---|---|---|---|
| 8,920,169 | B2 * | 12/2014 | Okuda | A61C 5/90 433/140 |
| 2010/0316973 | A1 * | 12/2010 | Remmers | A61F 5/566 433/214 |
| 2015/0209035 | A1 * | 7/2015 | Zemlok | A61B 17/07207 73/1.01 |
| 2018/0078334 | A1 * | 3/2018 | Lotan | A61C 19/04 |
| 2018/0214332 | A1 * | 8/2018 | Young | A63B 21/4039 |

FOREIGN PATENT DOCUMENTS

| | | | |
|---|---|---|---|
| CN | 206007543 | U | 3/2017 |
| TW | M564428 | U | 8/2018 |

* cited by examiner

ORAL REHABILITATION DEVICE AND MEDICAL TREATMENT SYSTEM THEREWITH

BACKGROUND OF THE INVENTION

1. Field of the Invention

The present invention relates to an oral rehabilitation device and medical treatment system therewith, and more particularly, to a hand-held automatic oral rehabilitation device and a medical treatment system.

2. Description of the Prior Art

The temporomandibular joint is a joint comprising the skull bone and the mandible, and the joint allows the mandible (or the lower jaw) to open and close in a vertical direction, move forward and backward, and shift left and right. After oral surgery or radiation therapy, a patient may avoid opening his/her mouth due to pain, thereby causing issues such as adhesion of wounds inside the mouth, fibromyalgia of muscles or degenerative joint diseases. Radiation therapy may also induce side effects such as stiffness in the jaw, fibrosis of tissues in the neck and therefore stiffness of the neck, or fibrosis of the temporomandibular joint, leading to the inability of the patient to exercise his/her lower jaw. If the patient does not aggressively participate in rehabilitation, he/she may eventually be unable to open his/her mouth to eat or to brush his/her teeth, resulting in diseases such as oral mucositis, cavities and/or gingivitis.

If the patient is willing to participate in oral rehabilitation, there are currently four mainstream methods of rehabilitation: (1) insert stacks of tongue depressors into the mouth to force the mouth to open, and gradually increase the number of tongue depressors as rehabilitation continues. However, the force applied during rehabilitation cannot be easily controlled, and the patient (hereinafter referred to as the user) may easily give up due to pain. (2) Force open the upper and lower jaw of the user directly via medical pliers, but this method may hurt the user's teeth and gum. (3) Open the mouth using specially designed jaw opener, and rotate the jaw opener to force the mouth to open. However, this method may still hurt the user's teeth and gum and the force of rotation cannot be easily controlled. (4) Insert a wedge-like or cone-like structure, with a smaller end on one side and a larger end on the other side, into the mouth of the user to force the mouth to open. The user can hold the larger end and insert the smaller end slowly into the mouth. However, the incisor tooth of the patient may break due to an external force as the structure is forced into the mouth in a horizontal direction.

In addition to the above-mentioned methods, manual oral rehabilitation devices are also available on the market that require the user to manually insert an oral rehabilitation device into the mouth. Then, the user would press down and release an end of the rehabilitation device repeatedly such that another end of the rehabilitation device would open or close, respectively, inside the patient's mouth, and assist in the rehabilitation effort. However, manual operation of such devices is time consuming and requires additional strength from the user. These devices are also inconvenient in that they require the user to record information such as a cycle number performed and a length of time using the device during each session. Such devices also cannot record an opening angle between the upper and lower jaw to monitor whether or not the opening angle is suitable for the user. For example, if the opening angle of the rehabilitation device is too large, the user may over-extend his/her jaw, causing secondary damage to the user. Prior art has demonstrated devices that use two parallel plates to open the user's upper and lower jaw while allowing a distance between the plates to be recorded as a rehabilitation record. However, sizes of such devices tend to increase with the opening angle due to the inherent structural design and operation mechanism. That is, the device would have a large body if it is required to achieve a large opening angle. Therefore, the overall device tends to be cumbersome.

Furthermore, medical professionals require a reference opening angle of the user's upper and lower jaw when recommending a rehabilitation procedure or process for after surgery or therapy and setting a rehabilitation target. For example, the rehabilitation target could be set at 90% of the opening angle before surgery or therapy. Therefore, the oral rehabilitation device should record/maintain a usage record or rehabilitation record of the user.

In the above-mentioned rehabilitation method and devices, a rehabilitation process and corresponding end results cannot be systematically tracked. In the present invention, the user can easily carry and independently operate an oral rehabilitation device while using the device to keep track of parameters such as an opening angle, a cycle number of using the device, a holding time and/or a speed of opening and closing the upper and lower jaw of the user, along with relevant recommended parameters related to the rehabilitation process. Safety features to prevent the user from over-extending the upper and lower jaw are also built into the device. The oral rehabilitation device of the present invention can also communicate with a hospital storage unit containing a user information database and a treatment information database. In this manner, medical professionals can extract and analyze the rehabilitation record corresponding to the user from the oral rehabilitation device and/or plot a graph analyzing the above-mentioned parameters, helping the medical professionals to assist the user in reaching his/her rehabilitation target.

SUMMARY OF THE INVENTION

The present invention relates to an oral rehabilitation device and a medical treatment system, and more particularly, to a hand-held automatic oral rehabilitation device and medical treatment system for rehabilitating a user's oral cavity.

According to a first embodiment of the present invention, an oral rehabilitation device for rehabilitating the oral cavity of a user comprises a device body, a first activating member disposed on an end of the device body, an upper-jaw member and a lower-jaw member connected to the end of the device body, and a processing unit coupled to the first activating member. The upper-jaw member is configured to contact an upper tooth of the user. The lower-jaw member is configured to contact a lower tooth of the user. The processing unit is configured to control the first activating member to drive one of the upper-jaw member and the lower-jaw member to open or close relative to the other of the upper-jaw member and the lower-jaw member, such that an upper jaw and a lower jaw of the user can be rehabilitated.

Preferably, the first activating member is coupled to the lower-jaw member, and the first activating member is configured to drive the lower-jaw member to open or close relative to the upper-jaw member.

Preferably, a second activating member is coupled to the upper-jaw member; wherein, the second activating member drives the upper-jaw member to open or close relative to the lower-jaw member; wherein, the first activating member and the second activating member are both configured via the processing unit, such that the processing unit can drive the upper-jaw member and the lower-jaw member to open or close relative to each other.

Preferably, the first activating member and the second activating member are a servo motor, a stepper motor, or a gear motor. When a stepper motor or a gear motor is used, an angle tracker is simultaneously configured to monitor the opening and closing angle of the upper jaw and lower jaw of the user.

Preferably, the device body comprises a handle for the user to hold and a rotating base pivotally connected to the handle, such that the rotating base can retract or extend relative to the handle; wherein, the upper-jaw member, the lower-jaw member and the first activating member are all disposed on the rotating base; wherein, when the rotating base is rotated to retract relative to the handle, the oral rehabilitation device is in a retracted status; wherein, when the rotating base is rotated to extend relative to the handle, the oral rehabilitation device is in an extended status.

Preferably, the device body further comprises at least one pressure sensor disposed on the handle and configured to detect a pressure value; wherein, when the pressure value is between a predetermined pressure ranges, the processing unit activates the first activating member.

Preferably, the oral rehabilitation device further comprises a display unit coupled to the processing unit and configured to display an information screen. The information screen displays parameters at least including: an opening angle, a cycle number, a holding time, and a speed; wherein the opening angle is an angle between the upper jaw and the lower jaw when the upper jaw and the lower jaw are open; wherein the cycle number is a number of times the upper jaw and the lower jaw open and close relative to each other; wherein the holding time is a length of time the upper jaw and the lower jaw of the user remains open relative to each other; wherein the speed is a speed of the upper-jaw member and the lower-jaw member opening and/or closing relative to each other.

Preferably, the oral rehabilitation device further comprises an input unit coupled to the processing unit and operated to input at least one of the following parameters: the opening angle, the cycle number, the holding time, and the speed.

Preferably, the upper-jaw member further comprises a first part connected to the end of the device body and a first flat member detachably disposed on the first part, wherein the first flat member is configured to contact the upper tooth. The lower-jaw member further comprises a second part connected to the first activating member and a second flat member detachably disposed on the second part, wherein the second flat member is configured to contact the lower tooth. The first flat member and the second flat member cooperatively open the upper jaw and the lower jaw to a first angle.

Preferably, the upper-jaw member further comprises a first alternative incisor-canine tooth member detachably disposed on the first part and configured to contact an incisor or a canine tooth of the upper jaw; the lower-jaw member further comprises a second alternative incisor-canine tooth member detachably disposed on the second part and configured to contact an incisor or a canine tooth of the lower jaw; wherein the first alternative incisor-canine tooth member and the second alternative incisor-canine tooth member cooperatively open the upper jaw and the lower jaw to a second angle.

Preferably, the upper-jaw member further comprises a first alternative molar member detachably disposed on the first part and configured to contact a molar of the upper jaw; the lower-jaw member further comprises a second alternative molar member detachably disposed on the second part and configured to contact a molar of the lower jaw; wherein the first alternative molar member has a first alternative molar slot configured to contain the molar of the upper jaw; the second alternative molar member has a second alternative molar slot configured to contain the molar of the lower jaw; wherein the first alternative molar member and the second alternative molar member cooperatively open the upper jaw and the lower jaw to a third angle.

Preferably, the upper-jaw member and a first incisor-canine tooth member are detachably connected to the end of the device body; the lower-jaw member and a second incisor-canine tooth member are detachably connected to the first activating member; wherein, when the upper-jaw member is connected to the end of the device body and the lower-jaw member is connected to the first activating member, the upper-jaw member and the lower-jaw member respectively contacts the upper tooth and the lower tooth, and the upper-jaw member and the lower-jaw member cooperatively open the upper jaw and the lower jaw to a fourth angle. The first incisor-canine tooth member and the second incisor-canine tooth member are configured to contact an incisor or a canine tooth of the upper jaw and the lower jaw, respectively. The first incisor-canine tooth member and the second incisor-canine tooth member cooperatively open the upper jaw and the lower jaw to a fifth angle.

Preferably, the oral rehabilitation device further comprises a first molar member detachably connected to the end of the device body and a second molar member detachably connected to the first activating member; wherein the first molar member contacts a molar of the upper jaw, and the second molar member contacts a molar of the lower jaw. The first molar member has a first molar slot configured to contain the molar of the upper jaw; the second molar member has a second molar slot configured to contain the molar of the lower jaw; wherein the first molar member and the second molar member cooperatively open the upper jaw and the lower jaw to a sixth angle.

Preferably, the aforementioned first flat member, second flat member, first incisor-canine tooth member, second incisor-canine tooth member, first molar member, second molar member, upper-jaw member, lower-jaw member, first alternative incisor-canine tooth member, second alternative incisor-canine tooth member, first alternative molar member, second alternative molar member all have a first end adjacent to the device body and a second end opposite the first end. The oral rehabilitation device further comprises a pressure sensor disposed adjacent to the second end of at least one of the first flat member, the second flat member, the first alternative incisor-canine tooth member, the second alternative incisor-canine tooth member, the first alternative molar member, the second alternative molar member, the upper-jaw member, the lower-jaw member, the first incisor-canine tooth member, the second incisor-canine tooth member, the first molar member, and the second molar member, the pressure sensor being configured to detect a pressure value; wherein when the pressure value is greater than a pressure threshold value, the processing unit stops the first activating member; or controls the first activating member to drive one of the upper-jaw member and the lower-jaw member to close toward the other of the upper-jaw member and the lower-jaw member; or controls the first activating member to drive one of the upper-jaw member and the lower-jaw member to close toward the other of the upper-jaw member and the lower-jaw member until the pressure value detected by the pressure sensor is zero.

Preferably, the oral rehabilitation device further comprises a flex sensor disposed adjacent to the first end of at least one of the first flat member, the second flat member, the first alternative incisor-canine tooth member, the second alternative incisor-canine tooth member, the first alternative molar member, the second alternative molar member, the upper-jaw member, the lower-jaw member, the first incisor-canine tooth member, the second incisor-canine tooth member, the first molar member, and the second molar member, the flex sensor being configured to detect bending deformation; wherein when a bending deformation level is larger than a threshold bending deformation level, the processing unit stops the first activating member; or controls one of the first activating member to drive the upper-jaw member and the lower-jaw member to close toward the other of the upper-jaw member and the lower-jaw member.

Preferably, the processing unit of the oral rehabilitation device stores at least one of an opening angle data, a cycle number data, a holding time data, and a speed data during a rehabilitation process of the user into a device storage unit coupled to the processing unit.

According to another aspect of the present invention, a medical treatment system comprises a hospital storage unit having a user information database and a treatment information database. The user information database contains at least a rehabilitation record corresponding to a user, and the rehabilitation record includes at least one of the following parameters of the user: the opening angle, the cycle number, the holding time, and the speed. The treatment information database contains recommended treatment information that comprises at least one of the following parameters: a recommended opening angle, a recommended cycle number, a recommended holding time, and a recommended speed. The medical treatment system further comprises the aforementioned oral rehabilitation device with the processing unit, a device communication unit coupled to the processing unit, and a device storage unit coupled to the processing unit. The processing unit is configured to (1) store the rehabilitation record corresponding to the user in the device storage unit; (2) extract the rehabilitation record corresponding to the user from the user information database; (3) extract at least one of the parameters of the recommended treatment information from the treatment information database.

Preferably, the medical treatment system further comprises a hospital communication unit and a hospital processing unit. The hospital communication unit is configured to communicate with the aforementioned oral rehabilitation device through the device communication unit, and the hospital processing unit is coupled to the hospital storage unit and the hospital communication unit. The hospital processing unit is configured to integrate the rehabilitation record corresponding to the user in the user information database. The oral rehabilitation device, based on the recommended treatment information, controls the first activating member to drive the lower-jaw member to open or close relative to the upper-jaw member. In this manner, the upper jaw and the lower jaw of the user can be rehabilitated. When the hospital communication unit communicates with the device communication unit, the hospital processing unit extracts and analyzes the user's rehabilitation record by plotting at least a graph analyzing a daily opening angle data, a daily cycle number data, a daily holding time data, and a daily speed data all corresponding to the user.

In summary, the oral rehabilitation device of the present invention can rehabilitate an upper jaw and lower jaw of a user, as well as store a rehabilitation record of the user including an opening angle of the upper and lower jaw, a cycle number, a holding time, and speed information in the device. The oral rehabilitation device further comprises a flex sensor and a pressure sensor disposed on a first end of the first flat member, the second flat member, the first incisor-canine tooth member, the second incisor-canine tooth member, the first molar member, the second molar member, the upper-jaw member, the lower-jaw member, the first alternative incisor-canine tooth member, the second alternative incisor-canine tooth member, the first alternative molar member, and the second alternative molar member, wherein the first end is close to a device body and opposite to a second end of the above-mentioned members. The pressure sensor and the flex sensor are respectively configured to detect a pressure value and a bending deformation level. The pressure sensor is also disposed on a handle of the device. When the pressure of the handle as detected by the pressure sensor is within a specified range, the processing unit of the device activates the first activating member and/or the second activating member such that the user or an assistant can begin the rehabilitation process, rendering the oral rehabilitation device automatic in nature. When the pressure value and/or the bending deformation level of the sensors is larger than a threshold pressure value and/or a threshold bending deformation level, the sensors cause the device to stop at least one of the first activating member and the second activating member.

Additionally, the present invention can store the rehabilitation record in a user information database of a hospital storage unit of a medical treatment system. The medical treatment system can recommend an opening angle of the upper and lower jaw, a cycle number, a holding time, and a speed based on information from a treatment information database of the hospital storage unit, and relevant analysis can be made from the rehabilitation record to track the progress of the user along the rehabilitation process. In this manner, medical professionals can more effectively tailor a treatment plan and help the user to reach his/her rehabilitation target.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
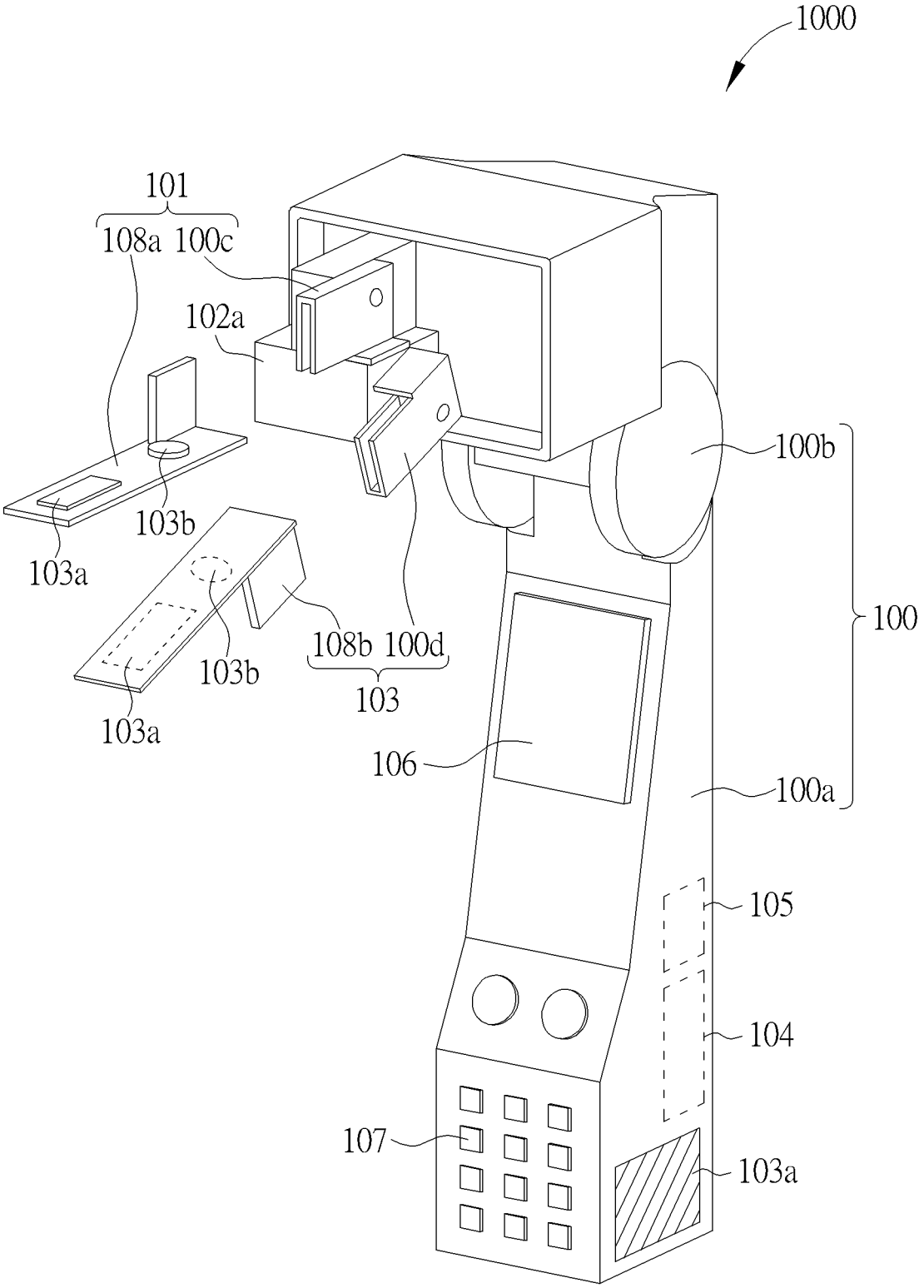
FIG. 1 is a schematic diagram illustrating an oral rehabilitation device having a first activating member according to an aspect of a first embodiment of the present invention, wherein a first flat member and a second flat member is respectively disposed on a first part and second part.
Figure 2:
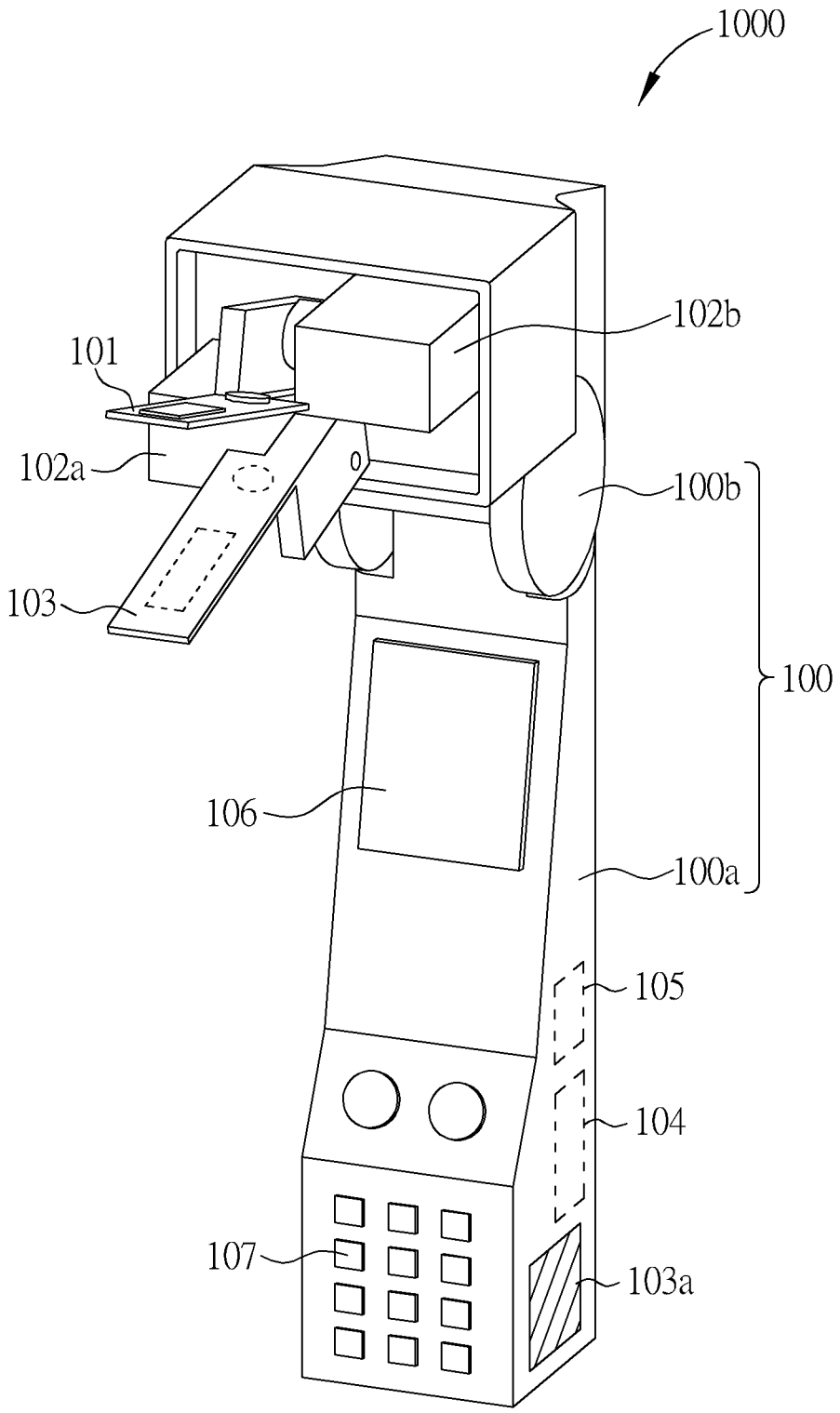
FIG. 2 is a schematic diagram illustrating an oral rehabilitation device having the first activating member and a second activating member according to an aspect of a second embodiment of the present invention.
Figure 3:
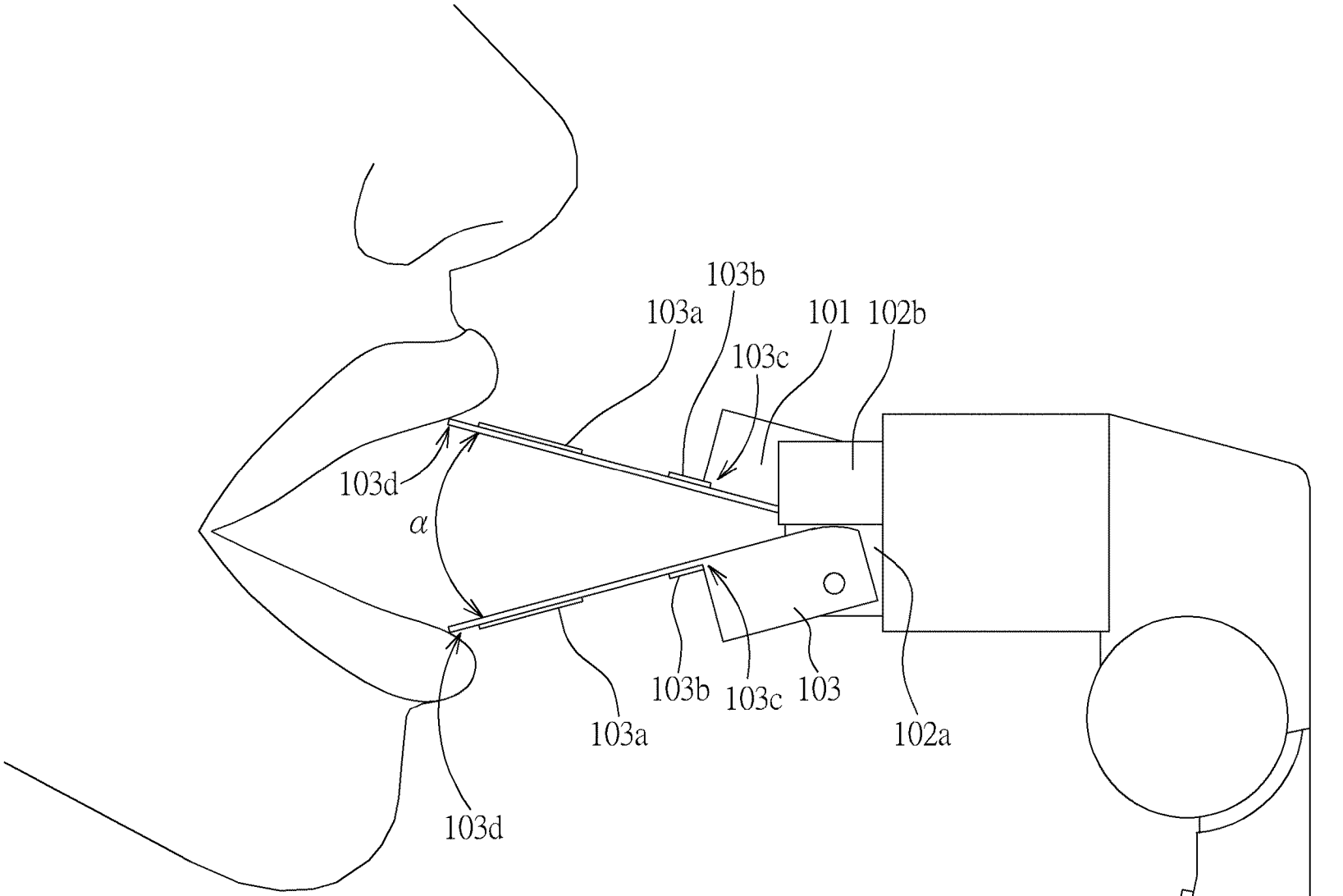
FIG. 3 is a schematic diagram illustrating a user operating the oral rehabilitation device to open his/her upper jaw and lower jaw at an angle using an upper-jaw member and a lower-jaw member according to the second embodiment.

Please refer to FIGS. 1-3 of the present invention. FIG. 1 is a schematic diagram illustrating an oral rehabilitation device 1000 having a first activating member 102*a* according to an aspect of the first embodiment of the present invention, wherein a first flat member 108*a* and a second flat member 108*b* is respectively disposed on a first part 100*c* and second part 100*d*. FIG. 2 is a schematic diagram illustrating an oral rehabilitation device 1000 having the first activating member 102*a* and a second activating member 102*b* according to an aspect of the second embodiment of the present invention. FIG. 3 is a schematic diagram illustrating a user operating the oral rehabilitation device 1000 to open his/her upper jaw and lower jaw at an angle α using an upper-jaw member 101 and a lower-jaw member 103 according to the second embodiment of the present invention.

As shown in FIG. 1, the oral rehabilitation device 1000 comprises a device body 100, the upper-jaw member 101, the first activating member 102*a*, the lower-jaw member 103, a processing unit 105, a display unit 106 and an input unit 107. The first activating member 102*a* is disposed on an end of the device body 100; the upper-jaw member 101 and the lower-jaw member 103 is connected to the same end of the device body 100, wherein the first activating member 102*a* is coupled to the lower-jaw member 103. The processing unit 105 is coupled to the first activating member 102*a* and is configured to control the first activating member 102*a* to drive the lower-jaw member 103 to open or close relative to the upper-jaw member 101; however, the present invention is not limited thereto: one of the upper-jaw member 101 and the lower-jaw member 103 can be configured via the first activating member 102*a* to open or close relative to the other of the upper-jaw member 101 and the lower-jaw member 103. Herein, the upper-jaw member 101 is detachably connected to an end of the device body 100. The upper-jaw member 101 comprises a first part 100*c* (connected to the end of the device body 100) and a first flat member 108*a* detachably disposed on the first part 100*c*. The lower-jaw member 103 is detachably connected to the same end of the device body 100 via the first activating member 102*a*. The lower-jaw member 103 further comprises a second part 100*d* (connected to the first activating member 102*a*) and a second flat member 108*b* detachably disposed on the second part 100*d*. The first flat member 108*a* and the second flat member 108*b* are both used to open the upper jaw and the lower jaw of a user to a first angle by contacting an upper tooth (or upper jaw) of the user and a lower tooth (or lower jaw) of the user. Additionally, the oral rehabilitation device 1000 can comprise a power source (such as a battery) or can connect to a power source to provide power for the oral rehabilitation device 1000 to operate.

As shown in FIG. 2, the oral rehabilitation device 1000 comprises a second activating member 102*b* according to a second embodiment of the present invention. The second activating member 102*b* is coupled to the upper-jaw member 101. The first activating member 102*a* and the second activating member 102*b* respectively drive the lower-jaw member 103 and the upper-jaw member 101 to open or close relative to the upper-jaw member 101 and the lower-jaw member 103. The first activating member 102*a* and the second activating member 102*b* are both configured via the processing unit 105, such that the processing unit 105 can drive the upper-jaw member 101 and the lower-jaw member 103 to open or close relative to each other.

As shown in FIG. 3, the upper-jaw member 101 is configured to contact the upper tooth (or upper jaw) of the user, and the lower-jaw member 103 is configured to contact the lower tooth (or lower jaw) of the user to rehabilitate the user's jaw. An opening angle of the user's upper and lower jaw is equivalent to an angle α between the lower-jaw member 103 and the upper-jaw member 101. The first activating member 102*a* and the second activating member 102*b* can be a servo motor, but the present invention is not limited thereto; for example, the first activating member 102*a* and the second activating member 102*b* can be a stepper motor or a gear motor that may be capable of reducing a movement speed. When the stepper motor or the gear motor is used, an angle tracker is simultaneously configured to monitor an opening and closing angle between the upper and lower jaw of the user, depending on practical applications.

Figure 4:
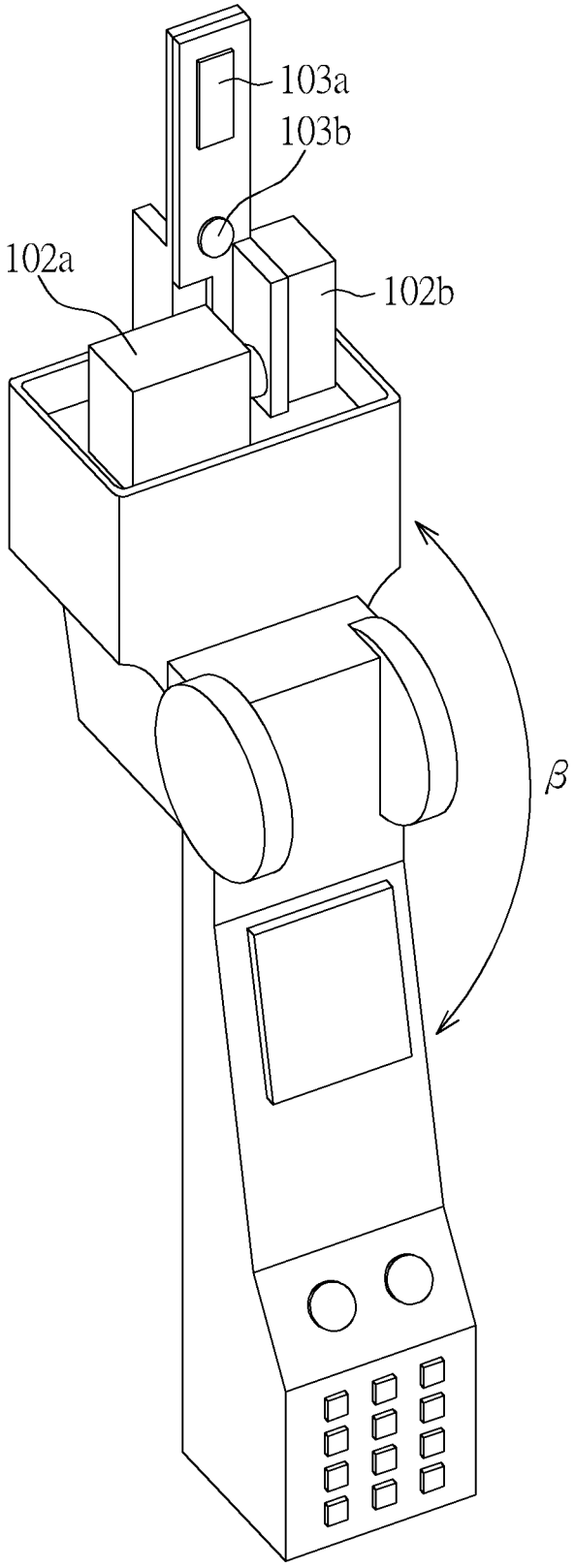
FIG. 4 is a schematic diagram illustrating the oral rehabilitation device at an extended status according to the second embodiment.
Figure 5:
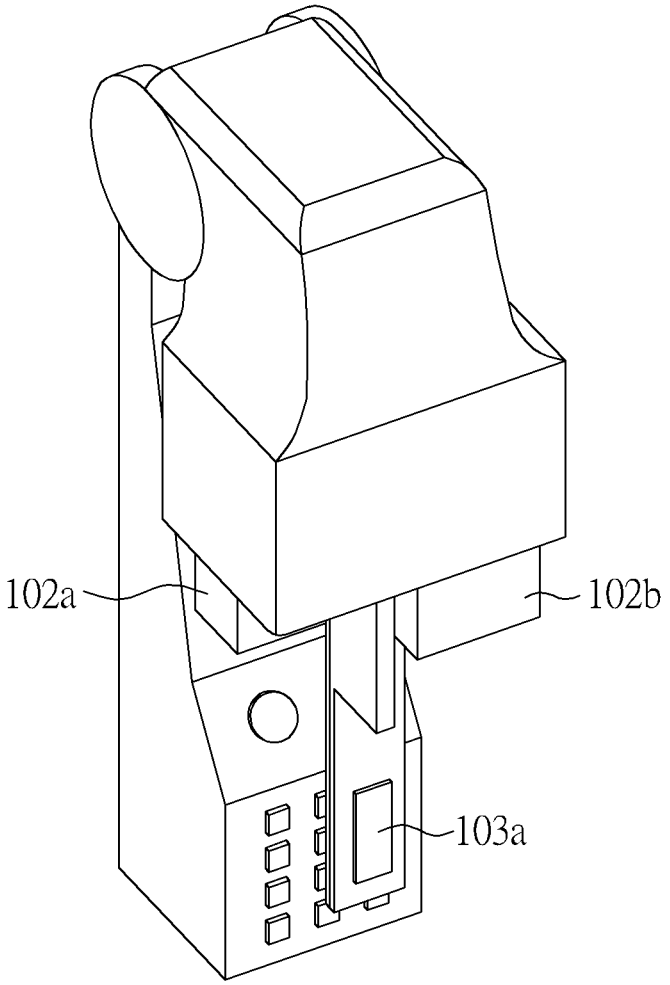
FIG. 5 is a schematic diagram illustrating the oral rehabilitation device at a retracted status according to the second embodiment.
Figure 6:
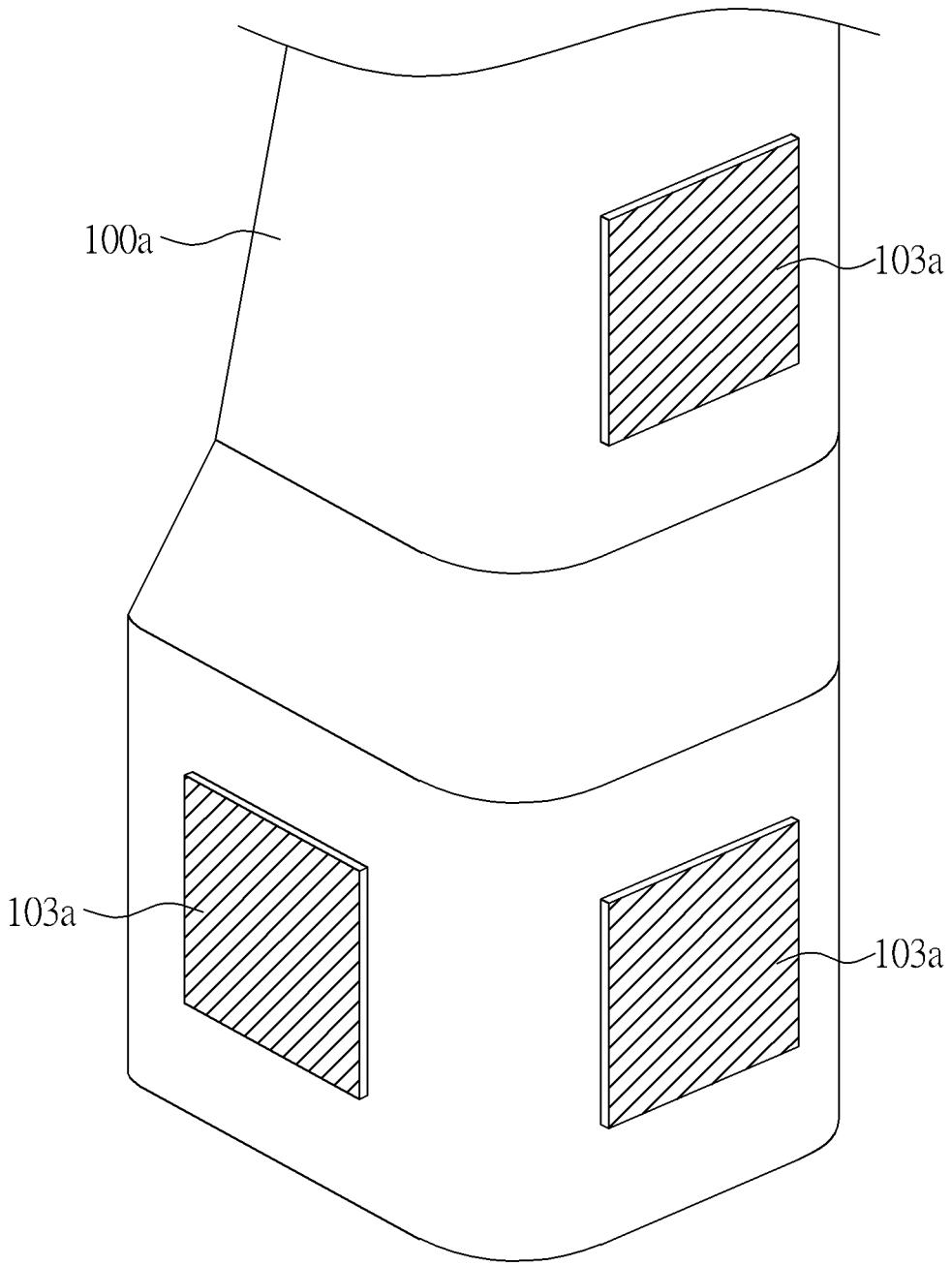
FIG. 6 is a schematic diagram illustrating a pressure sensor disposed on a handle of the oral rehabilitation device according to the first and second embodiment.

Please refer to FIGS. 1-2 along with FIGS. 4-6. FIG. 4 is a schematic diagram illustrating the oral rehabilitation device 1000 at an extended status according to the second embodiment. FIG. 5 is a schematic diagram illustrating the oral rehabilitation device 1000 at a retracted status according to the second embodiment. FIG. 6 is a schematic diagram illustrating a pressure sensor 103*a* disposed on a handle 100*a* of the oral rehabilitation device 1000 according to the first and second embodiment of the present invention.

As shown in FIGS. 1-2, the device body 100 comprises the handle 100*a* for the user to hold and a rotating base 100*b* pivotally connected to the handle 100*a*. In this manner, the rotating base 100*b* can retract relative to the handle 100*a* for the oral rehabilitation device 1000 to stay in the retracted status shown in FIG. 5. The rotating base 100*b* can also extend relative to the handle 100*a* for the oral rehabilitation device 1000 to stay in the extended status shown in FIG. 4. Both the first and second embodiments of the present invention can achieve the retracted and extended status. When the oral rehabilitation device 1000 is at the extended status, the rotating base 100*b* and the handle 100*a* have an angle β therebetween, wherein the angle β is between 0 degrees and 180 degrees. That is, when the rotating base

100*b* is rotated to be retracted relative to the handle 100*a* such that the angle β is substantially 0 degrees, the oral rehabilitation device 1000 is at the retracted status. When the rotating base 100*b* is rotated to be extended relative to the handle 100*a* such that the angle β is larger than 0 degrees, the oral rehabilitation device 1000 is at the extended status. In the present embodiment, the upper-jaw member 101, the first activating member 102*a*, the second activating member 102*b*, and the lower-jaw member 103 are all disposed on the rotating base 100*b*. As shown in FIGS. 1, 2, and 6, at least one pressure sensor 103*a* is disposed on the handle 100*a*. When the pressure sensor 103*a* detects a pressure value within a predetermined pressure range, the processing unit 105 activates the first activating member 102*a* and/or the second activating member 102*b* for the user or an assistant to start a rehabilitation process. In this manner, the oral rehabilitation device 1000 can automatically initiate the rehabilitation process regardless of whether the user or the assistant is using the device. If the user cannot comfortably operate the oral rehabilitation device 1000, the assistant can extend the rotating base 100*b* to a suitable angle to proceed with helping the user perform the rehabilitation process.

Figure 10:
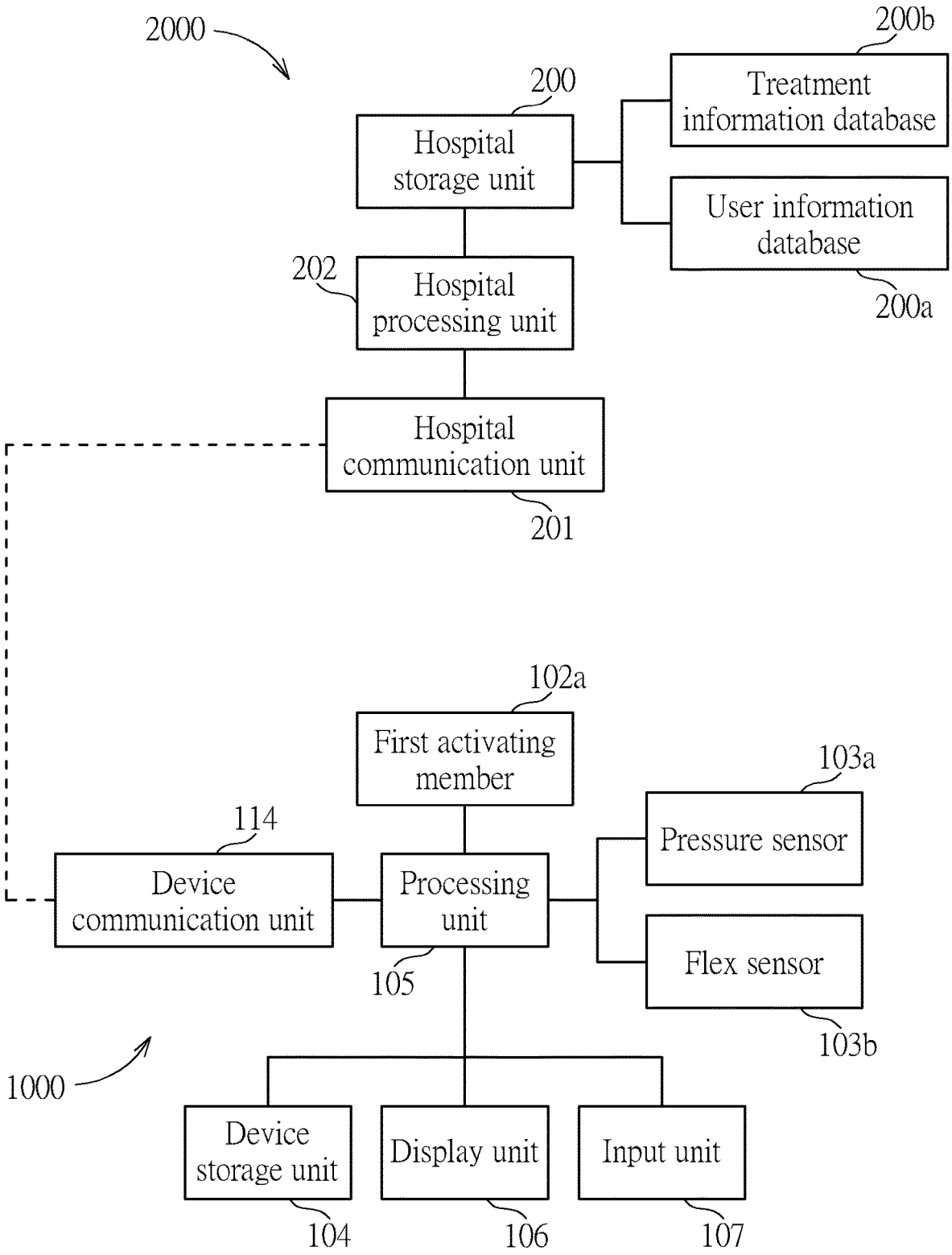
FIG. 10 is a functional block diagram illustrating a medical treatment system together with the oral rehabilitation device according to another aspect of the first embodiment.

Please refer to FIGS. 1, 2 and 10. FIG. 10 is a functional block diagram illustrating a medical treatment system together with the oral rehabilitation device according to another aspect of the present invention. As shown in FIGS. 1, 2 and 10, the oral rehabilitation device 1000 has a device storage unit 104 that, along with the first activating member 102*a*, is coupled to the processing unit 105. The processing unit 105 can also store a rehabilitation record corresponding to the user in the device storage unit 104, wherein the rehabilitation record comprises at least one of the following parameters: the opening angle of the user's upper and lower jaw (angle α), a cycle number, a holding time, and a speed; wherein, the opening angle is an angle between the upper jaw and the lower jaw when the upper jaw and the lower jaw are open; the cycle number is a number of times the upper jaw and the lower jaw open and close relative to each other; the holding time is a length of time the upper jaw and the lower jaw of the user remains open relative to each other; the speed is a speed of the upper-jaw member and the lower-jaw member opening or closing relative to each other when using the oral rehabilitation device 1000. According to the first embodiment of the present invention, the first activating member 102*a* is coupled to and configured by the processing unit 105 such that the processing unit 105 can drive the first activating member 102*a* to open or close the lower-jaw member 103. According to the second embodiment of the present invention, the first activating member 102*a* and the second activating member 102*b* are both coupled to and configured by the processing unit 105 such that the processing unit 105 can drive the first activating member 102*a* and the second activating member 102*b* to open or close the lower-jaw member 103 and the upper-jaw member 101.

Please refer back to FIG. 1. As shown in FIG. 1, the display unit 106 is configured to display an information screen containing parameters at least including: the opening angle (angle α), the cycle number, the holding time, and the speed. The input unit 107 has several buttons for inputting information, but an input method for the above-mentioned parameters is not limited thereto; other methods such as touch screen input are also applicable. The input unit 107 is coupled to the processing unit 105 and is operated to enter at least one of the following parameters: the opening angle (angle α), the cycle number, the holding time, and the speed.

Figure 7:
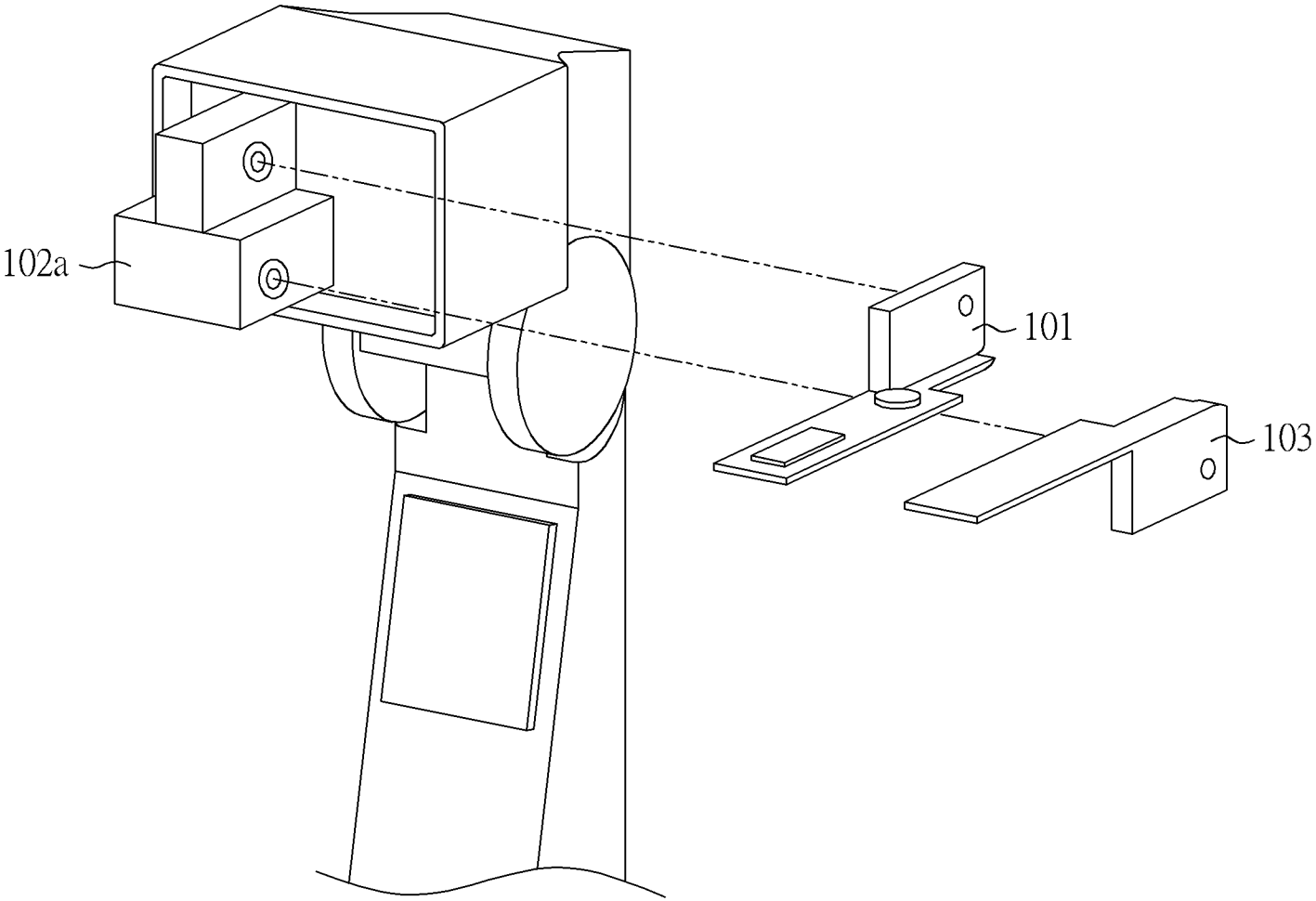
FIG. 7 illustrates a schematic diagram of an upper-jaw member and a lower-jaw member being detachably connected to an end of a device body and a first activating member, respectively, according to the first embodiment.
Figure 8:
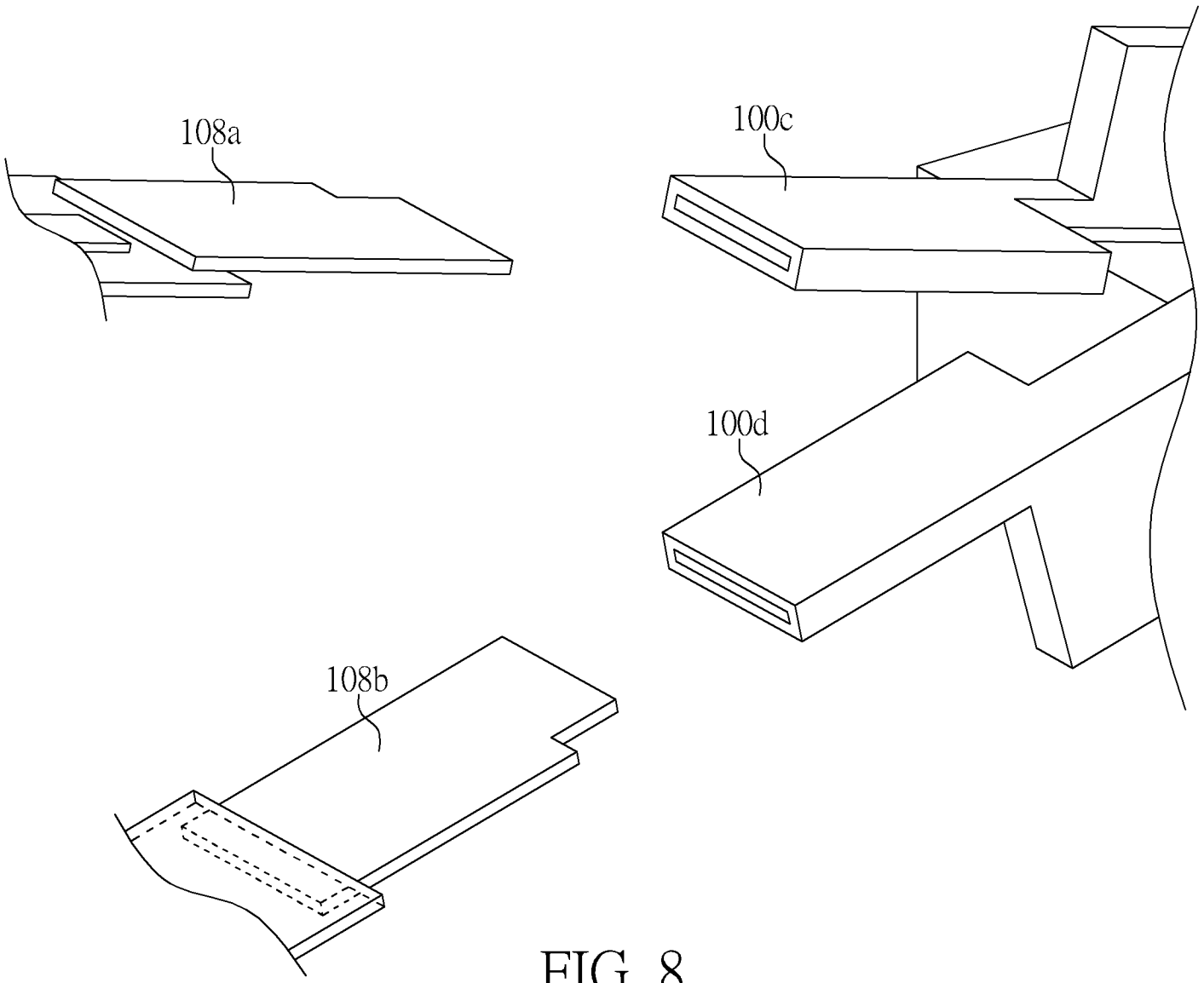
FIG. 8 is a schematic diagram illustrating a first flat member and a second flat member being detachably disposed on a first part and a second part, respectively, according to the second embodiment.
Figure 9:
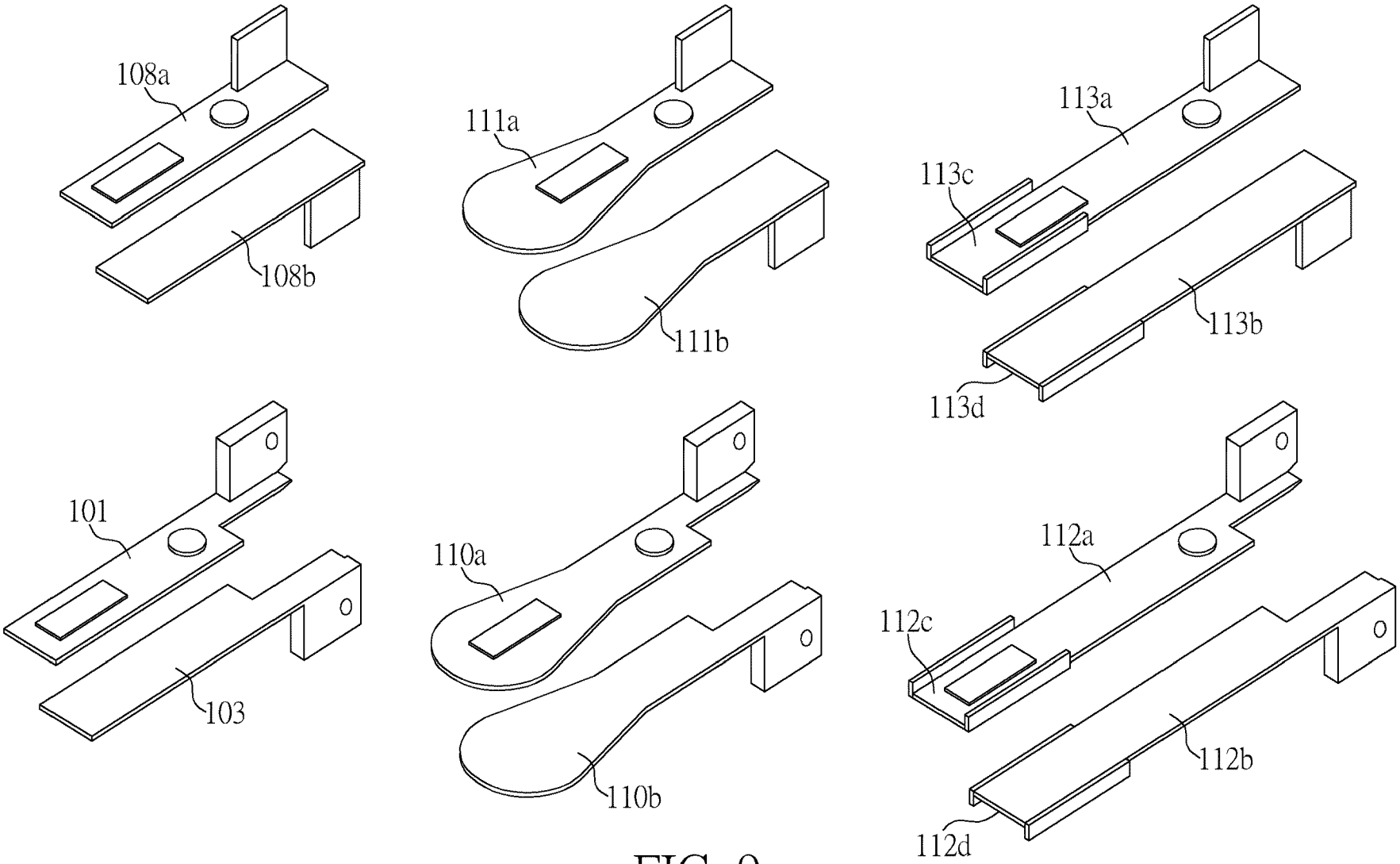
FIG. 9 is a schematic diagram illustrating the first flat member, the second flat member, a first incisor-canine tooth member, a second incisor-canine tooth member, a first molar member, a second molar member, the upper-jaw member, the lower-jaw member, a first alternative incisor-canine tooth member, a second alternative incisor-canine tooth member, a first alternative molar member, and a second alternative molar member according to the first and second embodiment.

Please refer to FIGS. 7-9. FIG. 7 illustrates a schematic diagram of the upper-jaw member 101 and the lower-jaw member 103 being detachably connected to the end of the device body 100 and the first activating member 102*a*, respectively, according to the first embodiment. FIG. 8 is a schematic diagram illustrating the first flat member 108*a* and the second flat member 108*b* being detachably disposed on the first part 100*c* and the second part 100*d*, respectively, according to another aspect of the second embodiment. FIG. 9 is a schematic diagram illustrating the first flat member 108*a*, the second flat member 108*b*, a first incisor-canine tooth member 110*a*, a second incisor-canine tooth member 110*b*, a first molar member 112*a*, a second molar member 112*b*, the upper-jaw member 101, the lower-jaw member 103, a first alternative incisor-canine tooth member 111*a*, a second alternative incisor-canine tooth member 111*b*, a first alternative molar member 113*a*, and a second alternative molar member 113*b* according to the first and second embodiment.

As shown in FIG. 7, the upper-jaw member 101 and the lower-jaw member 103 is detachably connected to the end of the device body 100 and the first activating member 102*a*, such as via screws to attach and remove; however the present invention is not limited thereto. The upper-jaw member 101 and the lower-jaw member 103 can also be switched to other detachable members including but not limited to those mentioned above, such as the first incisor-canine tooth member 110*a*, the second incisor-canine tooth member 110*b*, the first molar member 112*a* or the second molar member 112*b*, and be attached onto (and be removed from) the end of the device body 100 depending on practical demands. In the present embodiment, the members contacting the upper and lower tooth (or the upper and lower jaw) of the user is designed to be a single piece. However, the members can also be designed into two pieces (similar to the design shown in FIGS. 1 and 8) as a combination of the first flat member 108*a* and the first part 100*c*, and as a combination of the second flat member 108*b* and the second part 100*d*. The first flat member 108*a* and the second flat member 108*b* can also be switched to the first alternative incisor-canine tooth member 111*a* and the second alternative incisor-canine tooth member 111*b*, or the first alternative molar member 113*a* and the second alternative molar member 113*b*, as shown in FIG. 9, depending on practical demands.

As shown in FIG. 8, the first flat member 108*a* and the second flat member 108*b* can be detachably disposed on the first part 100*c* and the second part 100*d* in a manner different from that shown in FIG. 1. For example, the members can be inserted into the first part 100*c* and the second part 100*d* through a vertical section of the first part 100*c* and the second part 100*d* (shown in FIG. 1), or they can be inserted horizontally (as shown in FIG. 8) depending on designs of the corresponding members. The first alternative incisor-canine tooth member 111*a*, the second alternative incisor-canine tooth member 111*b*, the first alternative molar member 113*a*, the second alternative molar member 113*b* can also be detachably disposed on the first part 100*c* and the second part 100*d* utilizing a similar design.

The first and second alternative incisor-canine tooth members 111*a*, 111*b* of the present embodiment is configured to contact an incisor or a canine tooth of the upper jaw and the lower jaw, respectively. The first and second alternative incisor-canine tooth members 111*a*, 111*b* open the upper jaw and the lower jaw to a second angle; wherein the second angle is larger than the first angle. The first and second molar members 112*a*, 112*b* are configured to contact a molar of the upper jaw and the lower jaw, respectively. Preferably, a first molar slot 112*c* is formed on the first molar member 112*a*, a first alternative molar slot 113*c* is formed on the first alternative molar member 113*a*, and the first molar slot 112*c* along with the first alternative molar slot 113*c* are configured to contain the molar of the upper jaw. A second molar slot 112*d* is formed on the second molar member 112*b*, a second alternative molar slot 113*d* is formed on the second alternative molar member 113*b*, and the second molar slot 112*d* along with the second alternative molar slot 113*d* are configured to contain the molar of the lower jaw. The first and second alternative molar members 113*a*, 113*b* open the upper jaw and the lower jaw to a third angle; wherein the third angle is larger than the second angle.

The upper-jaw member 101 and the lower-jaw member 103 are respectively configured to contact the user's upper tooth (upper jaw) and lower tooth (lower jaw), wherein the upper-jaw member 101 and the lower-jaw member 103 open the upper jaw and the lower jaw to a fourth angle. In the first embodiment, the first incisor-canine tooth member 110*a* is detachably connected to the end of the device body 100, and the second incisor-canine tooth member 110*b* is detachably connected to the first activating member 102*a*. In this manner, the first incisor-canine tooth member 110*a* and the second incisor-canine tooth member 110*b* contacts an incisor or a canine tooth of the upper jaw and the lower jaw, respectively, while opening the upper jaw and the lower jaw to a fifth angle. The fifth angle is larger than the fourth angle. The first and second molar members 112*a*, 112*b* are detachably connected to the end of the device body 100 and the first activating member 102*a*, respectively; in this manner, the first and second molar members 112*a*, 112*b* contact a molar of the upper jaw and the lower jaw, respectively, while opening the upper jaw and the lower jaw to a sixth angle. The sixth angle is larger than the fifth angle.

Please refer to FIGS. 3 and 9. In FIGS. 3 and 9, the first flat member 108*a*, the second flat member 108*b*, the first incisor-canine tooth member 110*a*, the second incisor-canine tooth member 110*b*, the first molar member 112*a*, the second molar member 112*b*, the upper-jaw member 101, the lower-jaw member 103, the first alternative incisor-canine tooth member 111*a*, the second alternative incisor-canine tooth member 111*b*, the first alternative molar member 113*a*, and the second alternative molar member 113*b* all have a first end adjacent to the device body 100 and a second end opposite to the first end (as exemplified by the first end 103*c* and the second end 103*d* of the upper-jaw member 101 and the lower-jaw member 103 in FIG. 3). The pressure sensor 103*a* is disposed adjacent to the second end 103*d* and configured to detect a pressure value; when the pressure value is larger than a threshold pressure value, the processing unit 105 stops at least one of the first activating member 102*a* and the second activating member 102*b*; or, the processing unit 105 controls the first activating member 102*a* to drive one of the upper-jaw member 101 and the lower-jaw member 103 to close relative to the other of the upper-jaw member 101 and the lower-jaw member 103; or, the processing unit 105 controls the first activating member 102*a* to drive one of the upper-jaw member 101 and the lower-jaw member 103 to close relative to the other of the upper-jaw member 101 and the lower-jaw member 103, until the pressure sensor 103*a* detects zero pressure. In this manner, the oral rehabilitation device 1000 ceases to open the user's upper and lower jaw, and the user's safety can be ensured. At least one flex sensor 103*b* is disposed adjacent to the first end 103*c* to detect a bending deformation level; when the bending deformation level is larger than a threshold bending deformation level, the processing unit 105 stops at least one of the first activating member 102*a* and the second activating member 102*b*; or, the processing unit 105 controls the first activating member 102*a* to drive one of the upper-jaw member 101 and the lower-jaw member 103 to close relative to the other of the upper-jaw member 101 and the lower-jaw member 103. In this manner, the first activating member 102*a* and/or the second activating member 102*b* can prevented the oral rehabilitation device 1000 from opening to an even larger angle when the pressure sensor 103*a* detects a pressure value larger than the threshold pressure value and/or when the flex sensor 103*b* detects a bending deformation level larger than the threshold bending deformation level. That is, the oral rehabilitation device 1000 of the present invention can selectively comprise at least one of the pressure sensor 103*a* and the flex sensor 103*b* to prevent the upper and lower jaw of the user from being opened beyond a rehabilitation angle recommended by medical professionals, thereby injuring the user. In other words, the configuration of the oral rehabilitation device 1000 having at least one of the pressure sensor 103*a* and the flex sensor 103*b* is within the scope of the present invention.

Please refer to FIG. 10. FIG. 10 is a functional block diagram illustrating a medical treatment system 2000 together with the oral rehabilitation device 1000 according to a first embodiment of the present invention. As shown in FIG. 10, the medical treatment system 2000 of the present invention comprises a hospital storage unit 200 having a user information database 200*a* and a treatment information database 200*b*. The user information database 200*a* stores at least the rehabilitation record corresponding to the user, wherein the rehabilitation record includes at least one of the following parameters: the opening angle (angle $\alpha$), the cycle number, the holding time, and the speed. The treatment information database 200*b* stores at least the following parameters: a recommended opening angle, a recommended cycle number, a recommended holding time, and a recommended speed.

FIG. 10 also shows the medical treatment system 2000 further comprising a hospital processing unit 202, a hospital communication unit 201 and a device communication unit 114 of the oral rehabilitation device 1000. Remaining components of the oral rehabilitation device 1000 in the present embodiment have identical structures and functions, and further description is omitted herein for simplicity. The hospital communication unit 201 is configured to communicate and be linked with the oral rehabilitation device 1000, and the hospital processing unit 202 is coupled to the hospital storage unit 200 and the hospital communication unit 201. The hospital processing unit 202 is configured to integrate the rehabilitation record corresponding to the user in the user information database 200*a*. In the present embodiment, the medical treatment system 2000 can be a server system, and the hospital processing unit 202 can be a central processing unit of the server system. The hospital communication unit 201 can be a network module (such as an Ethernet module) or a wireless communication module (such as a WiFi module or a Bluetooth module) of the server system, the present invention not limited thereto.

In practical application, medical professionals can use the oral rehabilitation device 1000 of the medical treatment system 2000 to rehabilitate the upper and lower jaw of the user. The medical professionals can refer to at least one of the recommended opening angle, the recommended cycle number, the recommended holding time, and the recommended speed stored in the treatment information database 200*b* as a basis for operating the oral rehabilitation device 1000 and driving the lower-jaw member 103 to open or close relative to the upper-jaw member 101 to initiate the rehabilitation process.

When the hospital communication unit 201 of the medical treatment system 2000 communicates with the device communication unit 114 of the oral rehabilitation device 1000, as shown in FIG. 10, the hospital processing unit 202 extracts the rehabilitation record corresponding to the user containing at least one of the opening angle data of the user's upper and lower jaw (angle α), the cycle number data, the holding time data, and the speed data from the device storage unit 104. Wherein, the opening angle data is a data regarding an angle (angle α) between the upper jaw and the lower jaw when the upper jaw and the lower jaw are open; the cycle number data is a data regarding a number of times the upper jaw and the lower jaw open and close relative to each other; the holding time data is a data regarding a length of time the upper jaw and the lower jaw of the user remains open relative to each other; and the speed data is a data regarding a speed of the upper-jaw member and the lower-jaw member opening and/or closing relative to each other. Then, the above-mentioned rehabilitation record is analyzed to plot a daily analysis graph based on the opening angle data, the cycle number data, the holding time data, and the speed data. Medical professionals can then use the graphs to assess and track the user's rehabilitation progress, thereby determine subsequent treatment plans.

The most substantial difference between the first and second embodiment of the present invention is that in the second embodiment, the second activating member 102*b* is configured to drive the upper-jaw member 101 to open and close relative to the lower-jaw member 103, such that the upper and lower jaw of the user can be rehabilitated. Components of the oral rehabilitation device 1000 in the second embodiment have identical structures and functions to the first embodiment, and further description is omitted herein for simplicity. The oral rehabilitation device 1000 of the medical treatment system 2000 in FIG. 10 also can be configured with the second activating member 102*b*.

The benefits and effects of the present invention can be summarized as follows: the oral rehabilitation device can rehabilitate the user's upper jaw and lower jaw, while storing an opening angle data, a cycle number data, a holding time data, and a speed data as a rehabilitation record. The oral rehabilitation device further comprises a pressure sensor and a flex sensor, both disposed on an upper-jaw member and a lower-jaw member. The sensors are also disposed on a detachable member that is configured to contact the user's lower tooth (that is, the incisor tooth, canine tooth, or molar tooth) or lower jaw. The pressure sensor and the flex sensor are configured to respectively detect a pressure value and a bending deformation level; when the pressure value and/or the bending deformation level are larger than a threshold pressure value and/or a threshold bending deformation level, the oral rehabilitation device stops a first activating member and/or a second activating member, to prevent the user's upper and lower jaw from opening beyond an opening angle recommended by medical professionals, and to prevent in injury. The pressure sensor is also disposed on a handle held by the user's hand, and is configured to allow a processing unit to activate the oral rehabilitation device when a pressure value within a predetermined pressure range is detected. Additionally, the rehabilitation record can also be stored in a user information database coupled to a hospital storage unit of a medical treatment system. The rehabilitation record can be compared with at least one of a recommended opening angle, a recommended cycle number, a recommended holding time, and a recommended speed stored in a treatment information database coupled with the hospital storage unit of the medical treatment system. Daily analysis graphs can then be plotted using the comparison data to monitor the rehabilitation progress of the user. In this manner, medical professionals can more effectively tailor a treatment plan and help the user to reach his/her rehabilitation target.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An oral rehabilitation device for rehabilitating the oral cavity of a user, comprising:

a device body;

a first activating member disposed on an end of the device body;

an upper-jaw member connected to the end of the device body, the upper-jaw member being configured to contact an upper tooth of the user;

a lower-jaw member connected to the end of the device body, the lower-jaw member being configured to contact a lower tooth of the user; and a processing unit coupled to the first activating member, the processing unit being configured to control the first activating member to drive one of the upper-jaw member and the lower-jaw member to open or close relative to the other of the upper-jaw member and the lower-jaw member such that an upper jaw and a lower jaw of the user can be rehabilitated;

a first flex sensor disposed on the upper-jaw member or the lower-jaw member and configured to detect a first bending deformation level, wherein when the first bending deformation level detected by the first flex sensor is larger than a first threshold bending deformation level, the processing unit stops the first activating member, or controls the first activating member to drive one of the upper-jaw member and the lower-jaw member to close toward the other one of the upper-jaw member and the lower-jaw member.

2. The oral rehabilitation device of claim 1, wherein the first activating member is coupled to the lower-jaw member, and the first activating member is configured to drive the lower-jaw member to open or close relative to the upper-jaw member.

3. The oral rehabilitation device of claim 2, further comprising:

a second activating member coupled to the upper-jaw member;

wherein the second activating member drives the upper-jaw member to open or close relative to the lower-jaw member;

wherein the first activating member and the second activating member are both configured via the processing unit, such that the processing unit can drive the upper-jaw member and the lower-jaw member to open or close relative to each other.

4. The oral rehabilitation device of claim 3, wherein the first activating member and the second activating member are a servo motor, a stepper motor, or a gear motor.

5. The oral rehabilitation device of claim 1, wherein the device body comprises:

a handle for the user to hold; and a rotating base pivotally connected to the handle, the rotating base being retractable or extendable relative to the handle;

wherein the upper-jaw member, the lower-jaw member and the first activating member are all disposed on the rotating base;

wherein when the rotating base is rotated to retract relative to the handle, the oral rehabilitation device is in a retracted status;

wherein when the rotating base is rotated to extend relative to the handle, the oral rehabilitation device is in an extended status.

6. The oral rehabilitation device of claim 5, wherein the device body further comprises:

at least one pressure sensor disposed on the handle, the pressure sensor being configured to detect a pressure value;

wherein when the pressure value is within a pressure range, the processing unit activates the first activating member.

7. The oral rehabilitation device of claim 1, further comprising:

a display unit coupled to the processing unit, the display unit being configured to display an information screen, wherein the information screen displays parameters at least including: an opening angle, a cycle number, a holding time, and a speed;

wherein the opening angle is an angle between the upper jaw and the lower jaw when the upper jaw and the lower jaw are open;

wherein the cycle number is a number of times the upper jaw and the lower jaw open and close relative to each other;

wherein the holding time is a length of time the upper jaw and the lower jaw of the user remains open relative to each other;

wherein the speed is a speed of the upper-jaw member and the lower-jaw member opening or closing relative to each other.

8. The oral rehabilitation device of claim 1, further comprising:

an input unit coupled to the processing unit, the input unit being operated to input at least one of the following parameters:

an opening angle, a cycle number, a holding time, and a speed;

wherein the opening angle is an angle between the upper jaw and the lower jaw when the upper jaw and the lower jaw are open;

wherein the cycle number is a number of times the upper jaw and the lower jaw open and close relative to each other;

wherein the holding time is a length of time the upper jaw and the lower jaw of the user remains open relative to each other;

wherein the speed is a speed of the upper-jaw member and the lower-jaw member opening and/or closing relative to each other.

9. The oral rehabilitation device of claim 1, wherein:

the upper-jaw member further comprises:

a first part connected to the end of the device body; and a first flat member detachably disposed on the first part, the first flat member being configured to contact the upper tooth;

the lower-jaw member further comprises:

a second part connected to the first activating member; and a second flat member detachably disposed on the second part, the second flat member being configured to contact the lower tooth;

wherein the first flat member and the second flat member cooperatively open the upper jaw and the lower jaw to a first angle.

10. The oral rehabilitation device of claim 9, wherein:

the upper-jaw member further comprises:

a first alternative incisor-canine tooth member detachably disposed on the first part, the first alternative incisor-canine tooth member being configured to contact an incisor or a canine tooth of the upper jaw;

the lower-jaw member further comprises:

a second alternative incisor-canine tooth member detachably disposed on the second part, the second alternative incisor-canine tooth member being configured to contact an incisor or a canine tooth of the lower jaw;

wherein the first alternative incisor-canine tooth member and the second alternative incisor-canine tooth member cooperatively open the upper jaw and the lower jaw to a second angle.

11. The oral rehabilitation device of claim 10, wherein:

the upper-jaw member further comprises:

a first alternative molar member detachably disposed on the first part, the first alternative molar member being configured to contact a molar of the upper jaw;

the lower-jaw member further comprises:

a second alternative molar member detachably disposed on the second part, the second alternative molar member being configured to contact a molar of the lower jaw;

wherein the first alternative molar member has a first alternative molar slot, and the first alternative molar slot is configured to contain the molar of the upper jaw; the second alternative molar member has a second alternative molar slot, and the second alternative molar slot is configured to contain the molar of the lower jaw;

wherein the first alternative molar member and the second alternative molar member cooperatively open the upper jaw and the lower jaw to a third angle.

12. The oral rehabilitation device of claim 1, wherein the upper-jaw member is detachably connected to the end of the device body, the lower-jaw member is detachably connected to the first activating member, and the oral rehabilitation device further comprises:

a first incisor-canine tooth member detachably connected to the end of the device body; and a second incisor-canine tooth member detachably connected to the first activating member;

wherein, when the upper-jaw member is connected to the end of the device body and the lower-jaw member is connected to the first activating member, the upper-jaw member and the lower-jaw member respectively contacts the upper tooth and the lower tooth;

wherein the upper-jaw member and the lower-jaw member cooperatively open the upper jaw and the lower jaw to a fourth angle;

wherein when the first incisor-canine tooth member is connected to the end of the device body and the second incisor-canine tooth member is connected to the first activating member, the first incisor-canine tooth member contacts an incisor or a canine tooth of the upper jaw, and the second incisor-canine tooth member contacts an incisor or a canine tooth of the lower jaw;

wherein the first incisor-canine tooth member and the second incisor-canine tooth member cooperatively open the upper jaw and the lower jaw to a fifth angle.

13. The oral rehabilitation device of claim 12, wherein the oral rehabilitation device further comprises:

a first molar member detachably connected to the end of the device body; and a second molar member detachably connected to the first activating member;

wherein when the first molar member is connected to the end of the device body and the second molar member connected to the first activating member, the first molar member contacts a molar of the upper jaw, and the second molar member contacts a molar of the lower jaw;

wherein the first molar member has a first molar slot, and the first molar slot is configured to contain the molar of the upper jaw; the second molar member has a second molar slot, and the second molar slot is configured to contain the molar of the lower jaw;

wherein the first molar member and the second molar member cooperatively open the upper jaw and the lower jaw to a sixth angle.

14. The oral rehabilitation device of claim 11, wherein the first flat member, the second flat member, the first alternative incisor-canine tooth member, the second alternative incisor-canine tooth member, the first alternative molar member, and the second alternative molar member all have a first end adjacent to the device body and a second end opposite the first end, the oral rehabilitation device further comprises:

a pressure sensor disposed adjacent to the second end of at least one of the first flat member, the second flat member, the first alternative incisor-canine tooth member, the second alternative incisor-canine tooth member, the first alternative molar member, and the second alternative molar member and configured to detect a pressure value;

wherein when the pressure value detected by the pressure sensor is greater than a pressure threshold value, the processing unit stops the first activating member, or controls the first activating member to drive one of the upper-jaw member and the lower-jaw member to close toward the other of the upper-jaw member and the lower-jaw member, or controls the first activating member to drive one of the upper-jaw member and the lower-jaw member to close toward the other of the upper-jaw member and the lower-jaw member until the pressure value detected by the pressure sensor is zero.

15. The oral rehabilitation device of claim 14, further comprising:

a second flex sensor disposed adjacent to the first end of the first flat member, the second flat member, the first alternative incisor-canine tooth member, the second alternative incisor-canine tooth member, the first alternative molar member, the second alternative molar member and configured to detect a second bending deformation level;

wherein when the second bending deformation level detected by the second flex sensor is larger than a second threshold bending deformation level, the processing unit stops the first activating member, or controls the first activating member to drive one of the upper-jaw member and the lower-jaw member to close toward the other of the upper-jaw member and the lower-jaw member.

16. The oral rehabilitation device of claim 13, wherein the upper-jaw member, the lower-jaw member, the first incisor-canine tooth member, the second incisor-canine tooth member and the first molar member, the second molar member all have a first end adjacent to the device body and a second end opposite the first end, the oral rehabilitation device further comprises:

a pressure sensor disposed adjacent to the second end of at least one of the upper-jaw member, the lower-jaw member, the first incisor-canine tooth member, the second incisor-canine tooth member, the first molar member, and the second molar member and configured to detect a pressure value;

wherein when the pressure value detected by the pressure sensor is greater than a pressure threshold value, the processing unit stops the first activating member, or controls the first activating member to drive one of the upper-jaw member and the lower-jaw member to close toward the other of the upper-jaw member and the lower-jaw member.

17. The oral rehabilitation device of claim 16, wherein the first flex sensor is disposed adjacent to the first end of the upper-jaw member or the first end of the lower-jaw member, the oral rehabilitation device_further comprises:

a second flex sensor disposed adjacent to the first end of at least one of the first incisor-canine tooth member, the second incisor-canine tooth member, the first molar member, and the second molar member and configured to detect a second bending deformation level;

wherein when the second bending deformation level detected by the second flex sensor is larger than a second threshold bending deformation level, the processing unit stops the first activating member, or controls the first activating member to drive one of the upper-jaw member and the lower-jaw member to close toward the other of the upper-jaw member and the lower-jaw member.

18. The oral rehabilitation device of claim 1, further comprising:

a device storage unit coupled to the processing unit, wherein the processing unit stores at least one of an opening angle data, a cycle number data, a holding time data, and a speed data of the user during a rehabilitation process into the device storage unit, wherein:

the opening angle data is a data regarding an angle between the upper jaw and the lower jaw when the upper jaw and the lower jaw are open;

the cycle number data is a data regarding a number of times the upper jaw and the lower jaw open and close relative to each other;

the holding time data is a data regarding a length of time the upper jaw and the lower jaw of the user remains open relative to each other; and the speed data is a data regarding a speed of the upper-jaw member and the lower-jaw member opening and/or closing relative to each other.

19. A medical treatment system comprising:

a hospital storage unit having a user information database and a treatment information database;

wherein the user information database contains at least a rehabilitation record corresponding to a user, the rehabilitation record includes at least one of the following parameters of the user: an opening angle, a cycle number, a holding time, and a speed;

wherein the treatment information database contains at least one of the following parameters: a recommended opening angle, a recommended cycle number, a recommended holding time, and a recommended speed;

wherein the opening angle is an angle between the upper jaw and the lower jaw when the upper jaw and the lower jaw are open, the cycle number is a data regarding a number of times the upper jaw and the lower jaw open and close relative to each other, the holding time is a length of time the upper jaw and the lower jaw of the user remains open relative to each other; and the speed is a speed of the upper-jaw member and the lower-jaw member opening and/or closing relative to each other; and an oral rehabilitation device comprising:

a device body;

a first activating member disposed on an end of the device body;

an upper-jaw member connected to the end of the device body, the upper-jaw member being configured to contact an upper tooth of the user;

a lower-jaw member connected to the end of the device body, the lower-jaw member being configured to contact a lower tooth of the user;

a processing unit coupled to the first activating member, the processing unit being configured to control the first activating member to drive one of the upper-jaw member and the lower-jaw member to open or close relative to the other of the upper-jaw member and the lower-jaw member, such that an upper jaw and a lower jaw of the user can be rehabilitated;

a first flex sensor disposed on the upper-jaw member or the lower-jaw member and configured to detect a first bending deformation level, wherein when the first bending deformation level detected by the first flex sensor is larger than a first threshold bending deformation level, the processing unit stops the first activating member, or controls the first activating member to drive one of the upper-jaw member and the lower-jaw member to close toward the other one of the upper-jaw member and the lower-jaw member;

a device communication unit coupled to the processing unit; and a device storage unit coupled to the processing unit, wherein:

the processing unit is configured to:

store the rehabilitation record corresponding to the user in the device storage unit;

extract the rehabilitation record corresponding to the user from the user information database via the device communication unit;

extract at least one of the recommended opening angle, the recommended cycle number, the recommended holding time, and/or the recommended speed from the treatment information database via the device communication unit.

20. The medical treatment system of claim 19, further comprising:

a hospital communication unit configured to communicate with the oral rehabilitation device through the device communication unit;

a hospital processing unit coupled to the hospital storage unit and the hospital communication unit;

wherein the hospital processing unit is configured to integrate the rehabilitation record corresponding to the user in the user information database;

wherein the oral rehabilitation device, based on at least one of the recommended opening angle, the recommended cycle number, the recommended holding time, and the recommended speed in the treatment information database, controls the first activating member to drive the lower-jaw member to open or close relative to the upper-jaw member, such that the upper jaw and the lower jaw of the user can be rehabilitated;

wherein when the hospital communication unit communicates with the device communication unit, the hospital processing unit extract and analyze the rehabilitation record corresponding to the user from the device storage unit;

wherein the hospital processing unit is configured to plot at least a graph analyzing a daily opening angle data, a daily cycle number data, a daily holding time data, and a daily speed data all corresponding to the user according to the rehabilitation record from the device storage unit.

* * * * *